US007591654B2

(12) United States Patent
Neumetzler

(10) Patent No.: US 7,591,654 B2
(45) Date of Patent: Sep. 22, 2009

(54) CONDUCTOR CONNECTING MODULE FOR PRINTED CIRCUIT BOARDS

(75) Inventor: Heiko Neumetzler, Berlin (DE)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 10/565,740

(22) PCT Filed: Jun. 24, 2004

(86) PCT No.: PCT/EP2004/006821

§ 371 (c)(1),
(2), (4) Date: Jan. 23, 2006

(87) PCT Pub. No.: WO2005/020376

PCT Pub. Date: Mar. 3, 2005

(65) Prior Publication Data

US 2007/0111555 A1 May 17, 2007

(30) Foreign Application Priority Data

Jul. 25, 2003 (DE) ..... 103 33 913

(51) Int. Cl.
*H01R 12/00* (2006.01)

(52) U.S. Cl. ..... 439/79; 439/404

(58) Field of Classification Search ..... 439/404, 439/405, 79, 562, 751
See application file for complete search history.

(56) References Cited

U.S. PATENT DOCUMENTS

| | | | | |
|---|---|---|---|---|
| 4,550,962 | A | 11/1985 | Czeschka | 439/78 |
| 4,591,225 | A * | 5/1986 | Squitieri | 439/404 |
| 5,096,428 | A | 3/1992 | Lwee et al. | |
| 5,106,313 | A | 4/1992 | Lwee et al. | |
| 6,050,845 | A * | 4/2000 | Smalley et al. | 439/417 |
| 6,095,854 | A * | 8/2000 | Sommer et al. | 439/545 |
| 6,106,330 | A * | 8/2000 | Lin | 439/557 |
| 6,135,821 | A | 10/2000 | Liu | |
| 6,371,772 | B1 * | 4/2002 | Yoneyama et al. | 439/79 |
| 6,371,793 | B1 * | 4/2002 | Doorhy et al. | 439/404 |
| 6,511,353 | B2 * | 1/2003 | Champion et al. | 439/891 |
| 2003/0219999 | A1 * | 11/2003 | Minich et al. | 439/79 |

FOREIGN PATENT DOCUMENTS

| | | |
|---|---|---|
| AU | 701705 | 4/1997 |
| DE | 33 18 135 | 1/1988 |
| DE | 38 06 263 | 8/1989 |
| DE | 94 00 303 | 2/1995 |

(Continued)

OTHER PUBLICATIONS

Certified English Translation of German reference G9400303.3, 10 pages (Jun. 18, 2008).

*Primary Examiner*—Hien Vu
(74) *Attorney, Agent, or Firm*—Merchant & Gould P.C.

(57) ABSTRACT

The invention relates to a conductor connecting module for printed circuit boards, comprising a housing in which contact elements are disposed. Said contact elements have a first contact area that is configured as an insulation displacement contact, and a second contact area that is configured as a solderable contact pin. The contact pins are disposed at a right angle to the insulation displacement contacts so that the insulation displacement contacts, in the mounted state, lie in a plane parallel to the printed circuit board.

6 Claims, 4 Drawing Sheets

FOREIGN PATENT DOCUMENTS

Figure 1:
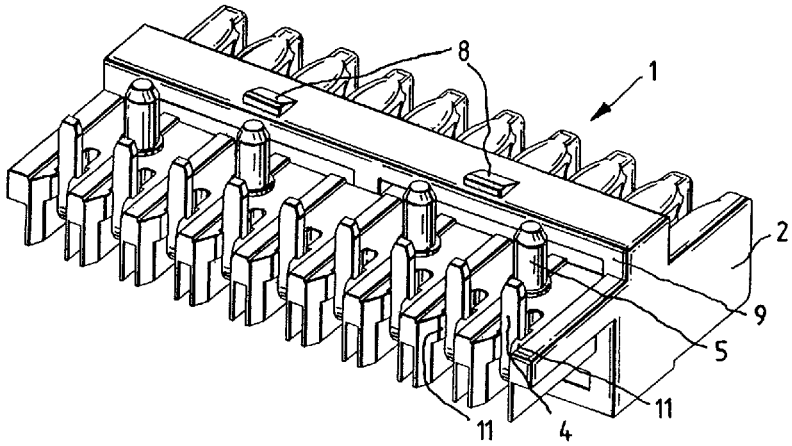

| | | |
|---|---|---|
| DE | 44 46 098 | 9/1996 |
| DE | 198 26 806 | 1/2000 |
| EP | 0 743 705 | 11/1996 |
| EP | 0 766 352 | 4/1997 |
| EP | 0766352 | 4/1997 |
| EP | 0 800 233 | 10/1997 |
| JP | 3016664 | 2/1991 |
| JP | 10-162884 | 6/1998 |
| KR | 10-0394531 | 9/2003 |
| WO | 97-02627 | 1/1997 |

* cited by examiner

CONDUCTOR CONNECTING MODULE FOR PRINTED CIRCUIT BOARDS

The invention relates to a conductor connection module for printed circuit boards as claimed in the preamble of claim 1.

A conductor connection module such as this is known, for example, from EP 0 766 352 B1. The conductor connection module has a housing in which contact elements are arranged, with the contact elements having a first contact area which is in the form of an insulation-displacement terminal contact, and having a second contact area which is in the form of a detachable contact pin. The housing is integral and is soldered to the printed circuit board via the contact pins. The contact elements are inserted from the upper face of the housing and are held by stops, with the contact pins projecting out of the lower face of the housing in the inserted state. Shielding plates are provided for shielding, are inserted from the lower face of the housing and are in each case arranged between two pairs of contact elements. The shielding plates likewise have contact pins, so that they can likewise be soldered to the printed circuit board and can be connected to a common ground line. Conductor connection modules such as these are also referred to, in the German language, as PCB print modules. Conductors can then be electrically connected to the printed circuit board via the contact areas, which are in the form of insulation-displacement terminal contacts. When the printed circuit boards are used in a housing or in an insert, then the printed circuit board must be connected in advance, and the housing or the insert must be removed for any retrospective change to the circuitry.

The invention is thus based on the technical problem of providing a conductor connection module for printed circuit boards which allows conductors to be connected more easily.

The technical problem is solved by the subject matter of the features of patent claim 1. Further advantageous refinements of the invention may be found in the dependent claims.

For this purpose, the contact elements are designed such that the longitudinal axes of the insulation-displacement terminal contacts lie parallel to the surface of the printed circuit board when the conductor connection module is in the installed state. This means that it is possible to ensure that the insulation-displacement terminal contacts in the case of inserts are accessible from the outside via the front panel. This in turn allows simple retrospective connection of the insulation-displacement terminal contacts without having to remove the insert or adjacent inserts. This also applies in the same sense where the printed circuit board is arranged in a housing. A further advantage is that the arrangement on the printed circuit board has a somewhat smaller physical height. In one preferred embodiment, the contact pins are arranged at right angles to the insulation-displacement terminal contacts, so that, in the installed state, they are at right angles to the surface of the printed circuit board, thus allowing simple plugging through and soldering. The contact elements are preferably integral and are preferably inserted from the end face of the housing that is associated with the insulation-displacement terminal contacts, with the contact pins subsequently being bent.

The housing is preferably an integral plastic housing.

In one preferred embodiment, the housing has fixing pins via which the conductor connection module can be fixed to and aligned with respect to the printed circuit board. The fixing pins may be in the form of a push fit or may have at least partially cylindrical latching. Alternatively, the fixing pins may be in the form of hot stamping pins.

In a further preferred embodiment, the housing has a stop surface in order to support the housing on an end surface of the printed circuit board. The printed circuit board can thus at least partially absorb the connection forces which occur during connection of the insulation-displacement terminal contacts.

Figure 2:
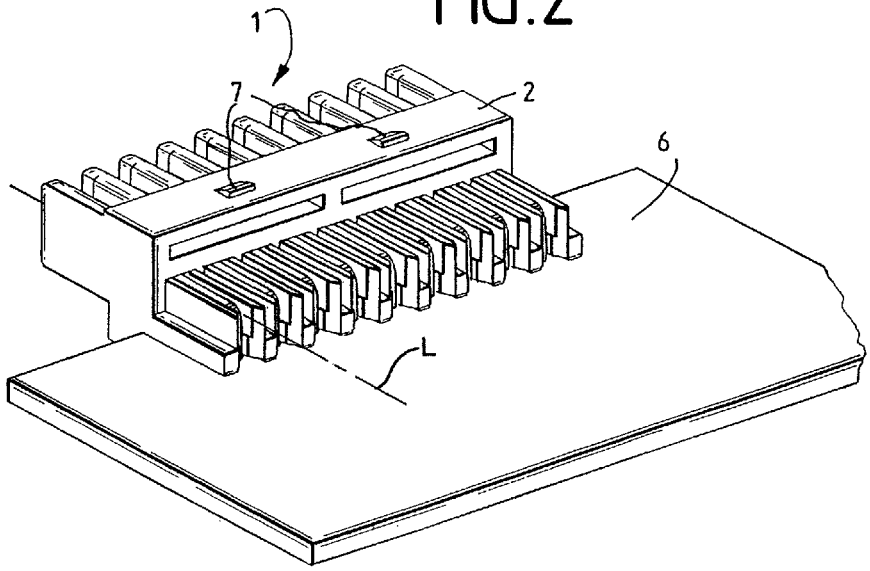
Figure 3:
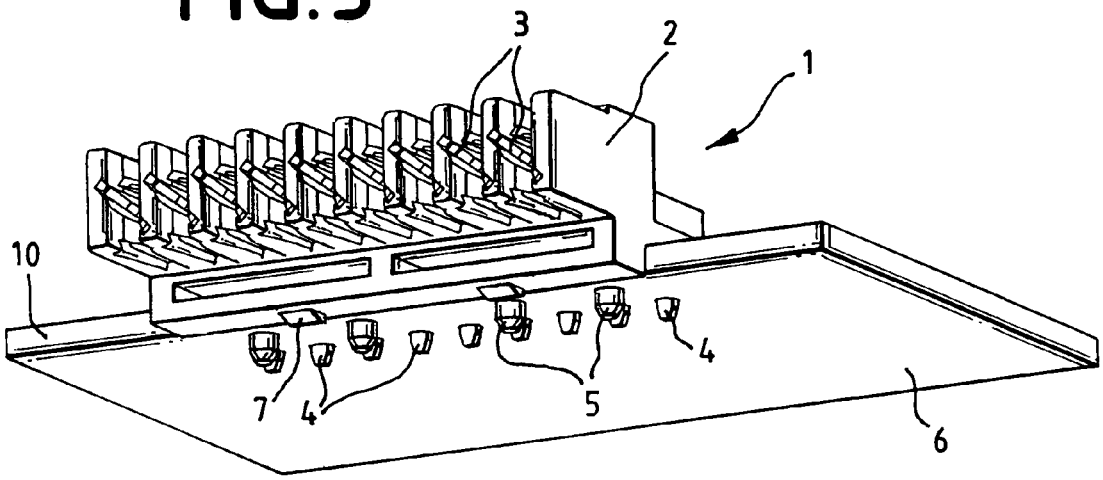
Figure 4:
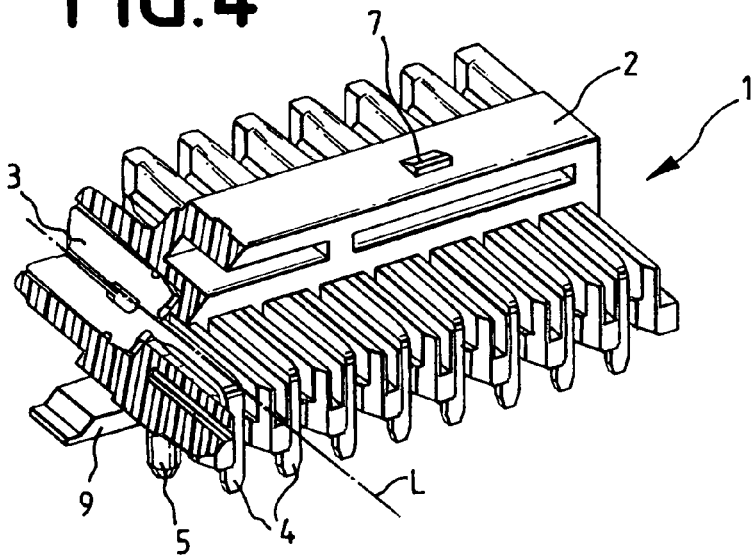
Figure 5:
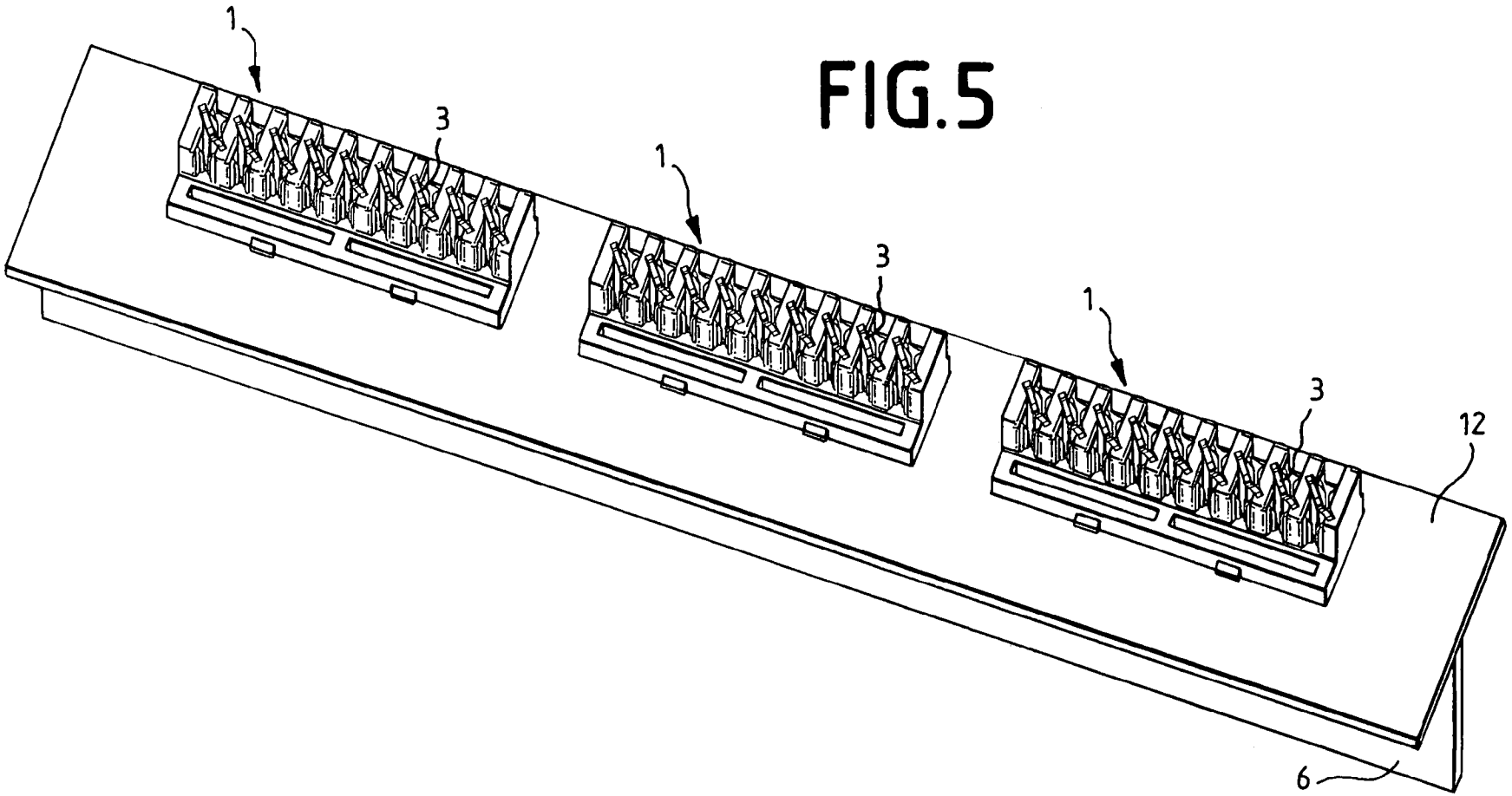
Figure 6:
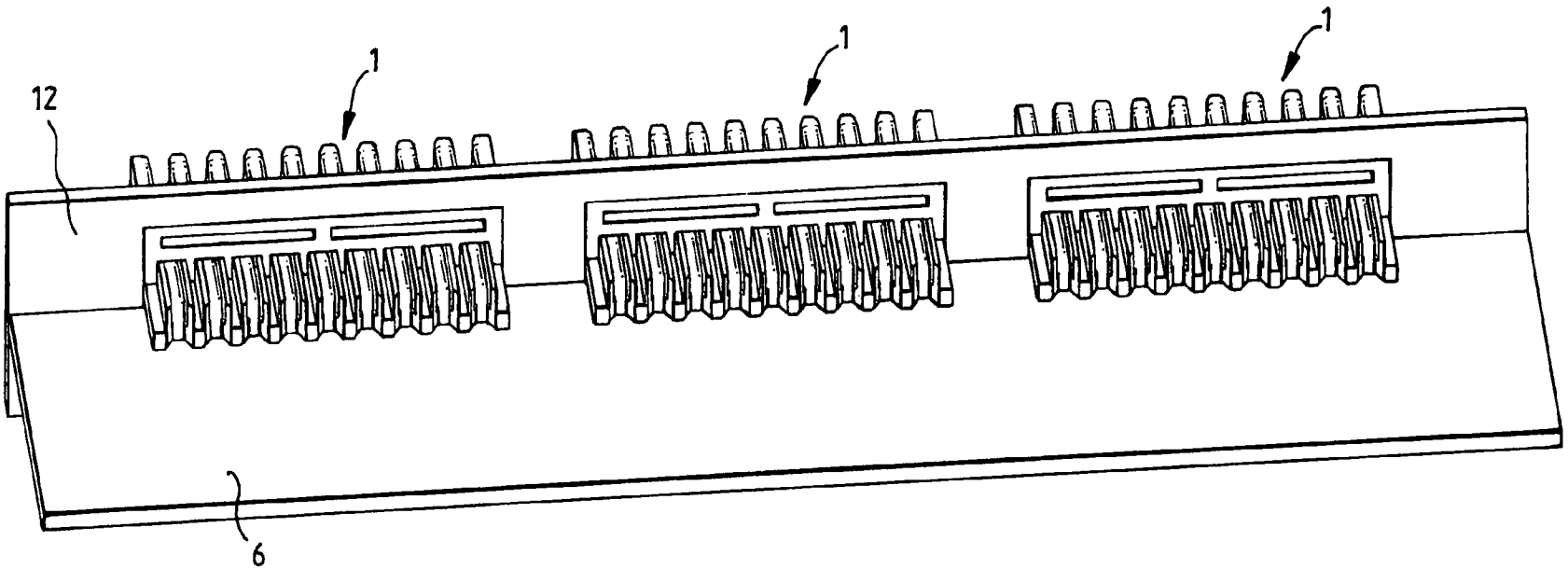

The invention will be explained in more detail in the following text with reference to a preferred exemplary embodiment. In the figures:

FIG. 1 shows a perspective view from underneath of a conductor connection module for printed circuit boards, FIG. 2 shows a perspective plan view of the conductor connection module in the installed state on a printed circuit board, FIG. 3 shows a perspective view from underneath of the illustration shown in FIG. 2, FIG. 4 shows a perspective illustration of the conductor connection module in the cutaway state, FIG. 5 shows a perspective front view of a front panel, and FIG. 6 shows a perspective rear view of the front panel.

FIG. 1 shows the conductor connection module 1 for printed circuit boards. The conductor connection module 1 has a housing 2 with contact elements, with the contact elements having a contact area which is in the form of an insulation-displacement terminal contact 3 and a contact area which is in the form of a contact pin 4. The contact pins 4 are in this case arranged at right angles to the insulation-displacement terminal contact 3 as can be seen, for example, in FIG. 4. By way of example, the contact pins 4 are in the form of simple solder pins based on plug-through technology, in the form of push-in pins or have a particular geometry for SMD soldering, with the embodiment in the form of solder pins based on plug-through technology being illustrated in FIGS. 1-4. In this case, the longitudinal axes L of the insulation-displacement terminal contacts 3 lie parallel to the surface of the printed circuit board 6 and to the cutting edges of the insulation-displacement terminal contact 3. The housing 2 has fixing pins 5, which are plugged through corresponding holes in the printed circuit board 6, as is illustrated in FIG. 3. Furthermore, the housing 2 has latching tabs 7, 8 on the upper face and lower face, by means of which the conductor connection module 1 can be latched to a front panel. In addition, the housing 2 has a stop surface 9, which supports the housing 2 on one end surface 10 of the printed circuit boards 6, as is illustrated in FIGS. 2 and 3. As can be seen in particular in FIG. 2, the rear part of the housing 2 also lies on the printed circuit board 6. Two formed areas 11 are arranged on the housing 2 in the area of the bend in the contact pin 4, and these hold and fix the contact pins 4. In comparison to cable plug connectors which are latched onto the end face of a printed circuit board, the conductor connection module 1 according to the invention allows use of different printed circuit board thicknesses as is actually required, for static reasons, for relatively large printed circuit boards 6, or as is standardized for use with 19-inch technology. The modules may be designed to have a pitch which complies with the standard electronic grid system of 5.08 mm, so that contact rows with a relatively large number of poles can be produced simply by arranging the conductor connection modules 1 in a row within the same grid system.

FIGS. 5 and 6 show three conductor connection modules 1 within a front panel 12. As can be seen in FIG. 5, the insulation-displacement terminal contacts 3 are freely accessible from the end face of the front panel 12, so that the conductors can easily be connected using standard tools, without having to remove the front panel 12. As can likewise be seen, when two or more inserts with front panels 12 are arranged one above the other, they do not interfere with one another in terms of connection.

LIST OF REFERENCE SYMBOLS

1 Conductor connection module
2 Housing
3 Insulation-displacement terminal contact
4 Contact pin
5 Fixing pin
6 Printed circuit board
7 Latching tab
8 Latching tab
9 Stop surface
10 End surface
11 Formed area
12 Front panel

The invention claimed is:

1. A conductor connection module for a printed circuit board, comprising:

a plurality of contact elements, and an integral housing in which the contact elements are arranged, the housing having a front elongated portion extending outwardly from a front end of the housing and a rear elongated portion extending outwardly from a rear end of the housing, the front and rear elongated portions each having a plurality of slots for receiving the contact elements, the contact elements having a first contact area which is in the form of at least one insulation-displacement terminal contact arranged at the front elongated portion of the housing, and the contact elements having a second contact area which is in the form of at least one contact pin arranged at the rear elongated portion of the housing, wherein longitudinal axes of the insulation-displacement terminal contacts lie parallel to a surface of the printed circuit board when the conductor connection module is installed on the printed circuit board;

a front panel having an opening;

wherein the contact pins are arranged at right angles to the insulation-displacement terminal contacts;

wherein the housing has a stop surface in order to support the housing on an end surface of the printed circuit board;

wherein the housing includes latching tabs on opposite top and bottom faces of the housing, the latching tabs latching the housing to the front panel, the front end of the housing including the insulation-displacement terminal contacts positioned in the opening of the front panel.

2. The conductor connection module as claimed in claim 1, wherein the housing is formed from plastic.

3. The conductor connection module as claimed in claim 2, wherein the housing has fixing pins which are arranged parallel to the contact pins.

4. A conductor connecting system, comprising:

a) a printed circuit board having an end surface and opposite facing major surfaces, the end surface extending between the major surfaces; and b) a conductor connection module including:

1) a plurality of contact elements each having a first contact area which is in the form of an insulation-displacement terminal, and having a second contact area which is in the form of a contact pin; and 2) an integral housing having a front elongated portion extending outwardly from a front end of the housing and a rear elongated portion extending outwardly from a rear end of the housing, the front and rear elongated portions each having a plurality of slots for holding the insulation-displacement terminals and the contact pins, respectively;

3) the housing mounted to the printed circuit board;

4) the contact pins electrically connected to the printed circuit board;

5) the insulation-displacement terminals each defining a longitudinal axis which is at a right angle relative to a longitudinal axis defined by each of the contact pins, the longitudinal axes of the insulation-displacement terminals extending parallel to the major surfaces of the printed circuit board;

c) a front panel having an opening;

wherein the housing has a stop surface in order to support the housing on the end surface of the printed circuit board;

wherein the housing includes latching tabs on opposite top and bottom faces of the housing, the latching tabs latching the housing to the front panel, the front end of the housing including the insulation-displacement terminals positioned in the opening of the front panel.

5. The conductor connecting system as claimed in claim 4, wherein the housing includes fixing pins arranged parallel to the contact pins, the fixing pins positioned in holes in the printed circuit board.

6. The conductor connecting system as claimed in claim 4, wherein the housing is formed from plastic.

* * * * *